US005094133A

United States Patent [19]

Schreiber

[11] Patent Number: 5,094,133

[45] Date of Patent: Mar. 10, 1992

[54] SCREWDRIVER WITH SWITCH-OFF MEANS FOR SCREW-IN DEPTH AND SCREW-IN TORQUE

[75] Inventor: Wolfgang Schreiber, Stuttgart, Fed. Rep. of Germany

[73] Assignee: C. & E. Fein GmbH & Co., Fed. Rep. of Germany

[21] Appl. No.: 529,153

[22] Filed: May 25, 1990

[30] Foreign Application Priority Data

Jun. 3, 1989 [DE] Fed. Rep. of Germany ..... 3918227

[51] Int. Cl.[5] ..... B25B 23/00; B25B 23/157

[52] U.S. Cl. ..... 81/474; 173/15; 173/29

[58] Field of Search ..... 173/12, 13, 15, 29; 81/473, 474, 475

[56] References Cited

U.S. PATENT DOCUMENTS

| | | | |
|---|---|---|---|
| 2,765,059 | 10/1956 | Amtsberg | 192/56 R |
| 2,927,672 | 3/1960 | Banner | 81/474 |
| 2,968,979 | 1/1961 | Aijala | 81/474 |
| 3,106,274 | 10/1963 | Madsen | 173/93.6 |
| 3,807,539 | 4/1974 | Reed | 192/150 |
| 4,606,443 | 8/1986 | Kimura | 192/20 |
| 4,630,512 | 12/1986 | Dürr | 81/475 |
| 4,655,103 | 4/1987 | Schreiber et al. | 81/474 |

FOREIGN PATENT DOCUMENTS

| | | | |
|---|---|---|---|
| 0155745 | 4/1989 | European Pat. Off. . | |
| 437803 | 11/1926 | Fed. Rep. of Germany . | |
| 1403393 | 10/1968 | Fed. Rep. of Germany . | |
| 2427713 | 1/1975 | Fed. Rep. of Germany . | |
| 2501189 | 7/1975 | Fed. Rep. of Germany . | |
| 2825023 | 12/1978 | Fed. Rep. of Germany . | |
| 3330888 | 3/1984 | Fed. Rep. of Germany . | |
| 3342880 | 6/1985 | Fed. Rep. of Germany . | |
| 3431630 | 3/1986 | Fed. Rep. of Germany . | |
| 3432376 | 3/1986 | Fed. Rep. of Germany . | |
| 3432382 | 3/1986 | Fed. Rep. of Germany . | |
| 3637852 | 3/1988 | Fed. Rep. of Germany . | |
| 3645027 | 12/1988 | Fed. Rep. of Germany . | |
| 3818924 | 6/1989 | Fed. Rep. of Germany . | |
| 2304447 | 10/1976 | France . | |
| 2309310 | 11/1976 | France . | |
| 51-15280 | 5/1976 | Japan . | |
| 1208212 | 10/1970 | United Kingdom | 81/475 |

*Primary Examiner*—Frank T. Yost
*Assistant Examiner*—C. Dexter
*Attorney, Agent, or Firm*—Barry R. Lipsitz

[57] ABSTRACT

To improve a power-operated screwing tool machine comprising a drive arranged in a housing, a screwing tool and a switch-off means for the screw-in depth including a depth stop held on the housing for fixing a screw-in depth and a clutch arranged between the drive and the tool drive shaft and transferrable by axial displacement of the tool drive shaft from a position of rest in the direction of the drive into a working position, the clutch comprising a clutch element driven by the drive, a clutch element connected to the tool drive shaft and an intermediate clutch element arranged between these clutch elements, with the intermediate clutch element forming with a first one of the clutch elements an entrainment clutch and with the second clutch element a release clutch, such that in addition to a switch-off means for the screw-in depth, the screwing tool machine comprises a switch-off means for the screw-in torque, it is proposed that the switch-off means for the screw-in depth be adapted to be switched over into a switch-off means for the screw-in torque which integrates the release clutch as torque-limiting element.

40 Claims, 7 Drawing Sheets

SCREWDRIVER WITH SWITCH-OFF MEANS FOR SCREW-IN DEPTH AND SCREW-IN TORQUE

Figure 1:
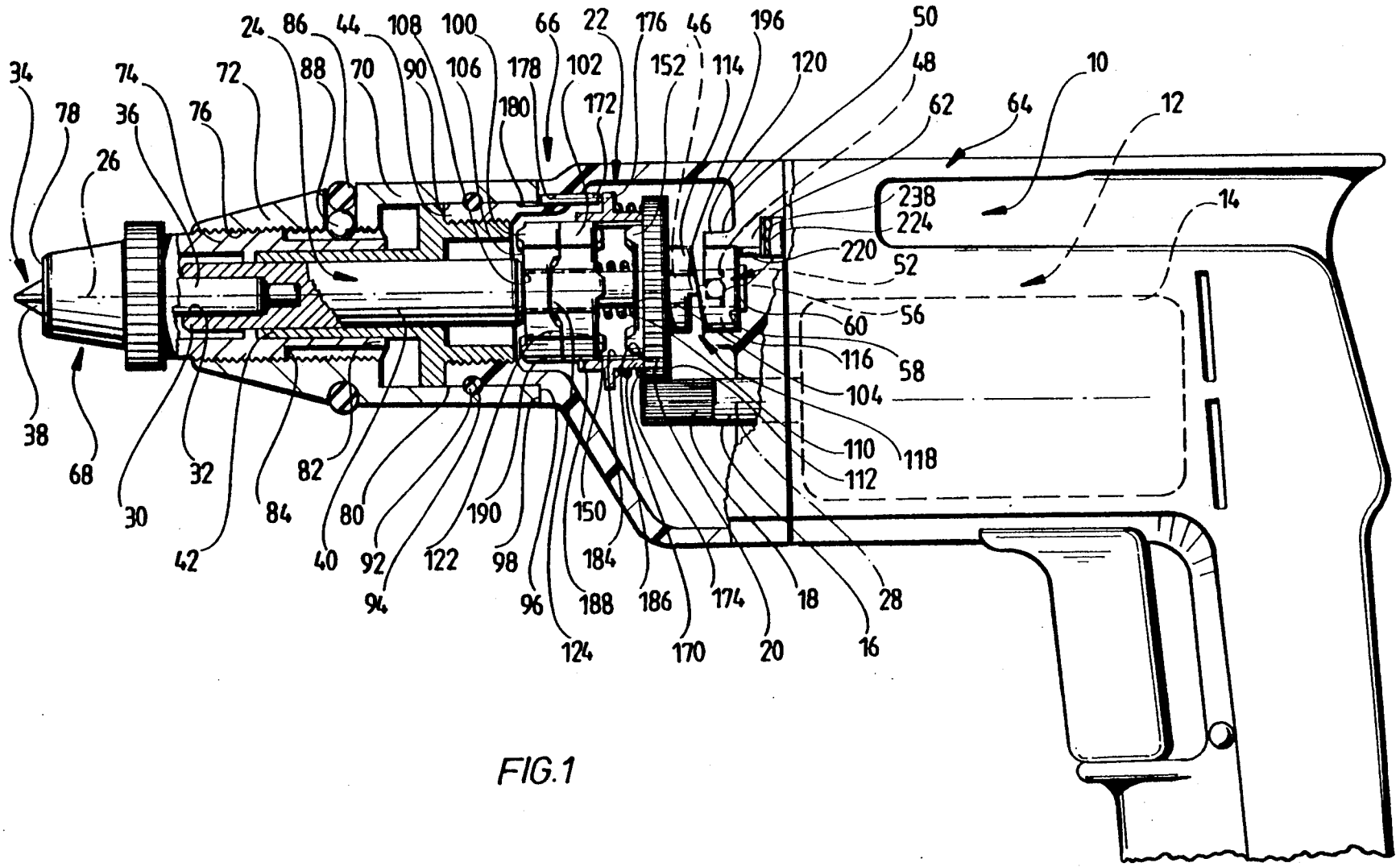

The invention relates to a power-operated screwing tool machine comprising a drive arranged in a housing, a screwing tool connected to a tool drive shaft axially displaceable relative to the housing, and a switch-off means for the screw-in depth including a depth stop held on the housing for fixing a screw-in depth and a clutch arranged between the drive and the tool drive shaft and transferable by axial displacement of the tool drive shaft from a position of rest in the direction of the drive into a working position. The clutch comprises a clutch element driven by the drive, a clutch element connected to the tool drive shaft and an intermediate clutch element arranged between these clutch elements. With a first one of the clutch elements, the intermediate clutch element forms an entrainment clutch which, in the case of load, axially displaces the intermediate clutch element from a load-free position towards the other, second clutch element into a load position and maintains torque transmission. With the second clutch element, the intermediate clutch element forms a release clutch which interrupts torque transmission when the screw-in depth is reached.

Such a power-operated screwing tool machine is known, for example, from European patent application No. 85115843.6 and from German patent 3 637 852. The clutch operates such that when the screw-in depth fixable by the depth stop is reached, the clutch disengages and switches off without chatter. Such screwing tool machines are mainly used as screwdrivers on construction sites as a large number of screws have to be tightened at a constant screw-in depth in dry construction work.

However, such a screwing tool machine with switch-off means for the screw-in depth cannot be used for screw-fastening tasks where two parts are to be screwed together with a predeterminable torque, i.e., for example, where two metal sheets spaced a short distance from each other are to be drawn towards each other with a predetermined torque by the screw and thereby made to rest against each other.

The object underlying the invention is, therefore, to so improve a screwing tool machine that it comprises a switch-off means for the screw-in torque in addition to a switch-off means for the screw-in depth.

This object is accomplished in accordance with the invention in a screwing tool machine of the kind described at the beginning in that the switch-off means for the screw-in depth can be switched over into a switch-off means for the screw-in torque which integrates the release clutch as torque-limiting element.

Hence the gist of the present invention is that the switch-off means for the screw-in depth which, in the normal case, independently of the existing counter-torque, merely interrupts the torque transmission when the preset screw-in depth is reached, can be switched over into a switch-off means for the screw-in torque, with the release clutch of the switch-off means for the screw-in depth being used as torque-limiting element although the primary function of the release clutch in the switching-off of the screw-in depth is not to limit the torque.

The advantage of the inventive solution is that it is made possible in a structurally very simple manner to operate one and the same screwing tool machine in two different operating modes and to thereby accomplish different types of screw-fastening tasks.

In connection with the principle underlying the invention, it has not been specified to what extent the entrainment clutch is included in the switch-over procedure. It is, for example, possible for a gear train which circumvents the entrainment clutch to be made connectable so the entrainment clutch as such is connected or disconnected. Structurally, it has, however, proven particularly simple and expedient for the entrainment clutch to be lockable against load-dependent axial displacement of the intermediate clutch element in the direction towards the first clutch element when the release clutch disengages.

The advantage of this solution is that merely partial locking of operation of the entrainment clutch is necessary to accomplish the inventive solution. Within the meaning of the invention, the entrainment clutch is to be understood as not disengaging when the torque transmission is interrupted, but as always remaining in engagement, yet permitting axial displacement of the intermediate clutch element relative to the first clutch element.

In principle, the locking of the entrainment clutch could occur in all intermediate positions, including the load-free and the load positions thereof. However, locking of the entrainment clutch can be implemented in a particularly simple way by the entrainment clutch being lockable against load-dependent, axial displacement of the intermediate clutch element upon disengagement of the release clutch in the load-free position or the load position, as these two positions are easiest to fix as defined positions.

It has proven particularly advantageous for the entrainment clutch to be lockable in the load-free position, as no axial displacement of the intermediate clutch element away from the first clutch element has occurred in this position, which provides a space-saving, compact arrangement of the intermediate clutch element relative to the first clutch element.

To achieve the clutch effect, it is expedient to provide a locking element which is adjustable between an effective position in which the entrainment clutch is locked and an ineffective position.

It is expedient for the locking element to be designed so as to be actuatable from outside the housing.

Since switchover from the switch-off means for the screwing depth to the switch-off means for the screw-in torque should preferably be possible in all rotary positions in the construction according to the invention, provision is expediently made for the locking element to be inactive in an effective position when the clutch is in a position of rest and to be activatable by transfer of the clutch from the position of rest to the working position. Hence the locking element does not engage initially in the position of rest and only transfer of the clutch into the work position simultaneously causes activation of the locking element. In this way, free rotatability of the elements of the entrainment clutch in the position of rest is, for example, still possible and can be used to allow the locking element in its effective position to become active when displacement of the clutch into the work position occurs.

Since, as described at the beginning, the depth stop constitutes an element of the switch-off means for the screw-in depth and is not necessary for the functioning of the switch-off means for the screw-in torque, it has proven expedient in a preferred embodiment for the depth stop to be adapted to be brought into an ineffective position.

In a particularly expedient solution, provision is made for the depth stop to be in the ineffective position when the entrainment clutch is locked, i.e., for coupling of the ineffective position of the depth stop with the locking of the entrainment clutch to occur in the inventive manner described above.

Insofar as such coupling is advantageous and desirable, this can be used in a further development of this embodiment for the locking element to be actuatable by the depth stop so that when the depth stop is brought into its ineffective position, this action simultaneously represents actuation of the locking element.

In order that the operator can clearly determine which operating mode the inventive screwing tool machine is operating in at present, it is highly expedient for the depth stop to be slippable onto the housing and for the locking element to be in its ineffective position when the depth stop is positioned on the housing and in its effective position when the depth stop is removed. Since, in this embodiment, the operator feels whether the depth stop is in position or not and this feeling simultaneously serves to actuate the locking element, this constitutes a particularly safe solution as far as handling is concerned.

Since the release clutch of the inventive solution is primarily designed to switch off in combination with the switch-off means for the screw-in depth at a certain screw-in depth and not when a limit torque is exceeded, it is particularly advantageous within the scope of the inventive solution to provide an adjustment device for adjustment of a release characteristic of the release clutch so that the release clutch can be adjusted by this adjustment device to the desired switch-off characteristic, in particular for the switching-off of the screw-in torque.

To enable the operator to do this in a simple way, provision is made for the adjustment device to be adjustable by an actuating element accessible from outside the housing so the operator has easy access to the adjustment device while he is working.

In the embodiments described so far, no concrete details have been given as to which characteristic features of the release clutch are to be adjustable. Within the scope of a preferred embodiment, it has proven particularly expedient for the release torque of the release clutch to be adjustable by the adjustment device, thereby making simple adaptation of the release clutch to the individually desired release torques possible.

Within the scope of the embodiments described above, it is particularly advantageous for the clutch elements and the intermediate clutch element to be arranged on one axis. Preferably, provision is even made for the clutch elements and the intermediate clutch element to be arranged coaxially with the tool drive shaft. In a structurally particularly simple solution, provision is made for the clutch elements and the intermediate clutch element to be arranged on the tool drive shaft, but at least the intermediate clutch element and the second clutch element must then be displaceable relative to the tool drive shaft.

In the embodiments described so far, no details have been given as to the structural design of the entrainment clutch. It has proven particularly advantageous for the entrainment clutch to have at least one actuating surface arranged at an incline to the axis of the clutch elements so as to act on a counter-surface upon rotation of the first clutch element and the intermediate clutch element relative to each other and to move the intermediate clutch element in the axial direction from the load-free position to the load position. With an entrainment clutch of such design, the axial displacement is triggered by rotation of the first clutch element and the intermediate clutch element relative to each other, which is easily achieved by the torque transmission according to the invention with the switch-off of the screw-in depth.

The actuating surface may be arranged in any desired way. It is, for example, conceivable for the actuating surface to be in the form of a guide surface extending at a corresponding incline for a ball as connecting element between the first clutch element and the intermediate clutch element. It is, however, also conceivable for the actuating surface to be formed by a connecting link on which a feeler bolt slides. In the simplest case, the connecting link track may be an inner rim of a bore on which a pin with a substantially smaller diameter than that of the bore slides. The actuating surface can be implemented in a particularly simple way by being designed as the side edge of a claw.

To achieve limitation of the relative rotation in the case of the actuating surface described above, provision is made for the rotation of the first clutch element and the intermediate clutch element relative to each other to be limited by a stop surface which is effective in the load position. The stop surface preferably extends transversely to the actuating surface. If claws are used as connecting elements between the first clutch element and the intermediate clutch element, the stop surface can be designed so as to be a side surface of the claw which, in particular, is parallel to the axis of the clutch elements.

In structurally very simple solutions of an entrainment clutch using claws as connecting elements, provision is made for the first clutch element and the intermediate clutch element to have claws with identically aligned side surfaces. In addition, it is advantageous for the claws to have identically aligned side flanks.

In the simplest case, this means that the claws of the first clutch element and of the intermediate clutch element are identical with each other.

In all cases in which the entrainment clutch is to be locked in the load-free position, it is expedient for the entrainment clutch in the load-free position to position in a defined manner the first clutch element and the intermediate clutch element relative to each other, in particular with respect to rotation of these elements relative to each other. Hence locking of both elements can be achieved in a simple way, whereas with a nondefined position of the elements of the entrainment clutch in the load-free position, this would only be possible with additional aids for positioning the two elements.

This positioning can be structurally achieved in a very simple way by the side flanks of successive claws of the intermediate clutch element or of the first clutch element centering in the defined load-free position the claw of the first clutch element or of the intermediate clutch element which engages between these.

In all embodiments in which the entrainment clutch is designed so as to require an actuating surface extending at an incline in order to bring about the axial displacement of the intermediate clutch element during transition from the load-free position to the load position, it is necessary in order for the clutch to function, for the intermediate clutch element to be spring-loaded in the direction of its load-free position. In particular, a spring is provided between the second clutch element and the intermediate clutch element to press these apart. In the last-mentioned case, as a further advantageous effect, this spring simultaneously causes the first clutch element to be spring-loaded in the direction of a load-free position.

In the embodiments described so far, no details of the release clutch have been given. From a structural viewpoint, it is very simple for the release clutch to be formed by cams arranged so as to face one another on the intermediate clutch element and on the second clutch element.

The cams are preferably arranged on a circular path about the axis of the intermediate clutch element. It is, furthermore, particularly advantageous, in order to achieve easy engagement of the cams while the machine is running, for spaces between the cams to be a multiple of the width of a cam so that the respective opposite cam can easily enter the spaces between the cams.

If the inventive entrainment clutch is designed so as to include an inclined actuating surface which brings about the axial displacement when the intermediate clutch element rotates relative to the first clutch element, it is particularly expedient for implementation of the inventive switchover to switch-off of the screw-in torque, for the locking element to lock the intermediate clutch element against rotation relative to the first clutch element. In particular, this is easiest to achieve by the locking element locking the relative rotation in the load-free position.

A large number of variants is conceivable for design of the locking element. It is, for example, possible for the locking element to lock the entrainment clutch in a frictionally connected manner. It is, however, particularly expedient for the coupling ring in its effective, activated position to lock the intermediate clutch element and the first clutch element in a rotationally fixed manner by positive connection, with the positiveconnection elements preferably extending parallel to the axis of the intermediate clutch element and the first clutch element.

It is particularly simple when the coupling ring has grooves for wedges of the intermediate clutch element and the first clutch element to engage therein, with the grooves and the wedges preferably extending in their longitudinal direction parallel to the axis to enable sliding motion of the coupling ring parallel to the axis.

In the embodiments described so far, no details have been given as to how the intermediate clutch ring is to be advantageously mounted and guided. A solution has proven particularly expedient in which the coupling ring is guided in its effective and ineffective positions by the intermediate clutch element coaxially therewith.

The simplest possibility of arranging the coupling ring makes provision for it to protrude in its ineffective position when the clutch is in the work position beyond the intermediate clutch element in the direction of the second clutch element, whereby engagement of the wedges of the first clutch element in the coupling ring is not possible. On the other hand, the coupling ring protrudes in its effective position when the clutch is in the work position beyond the intermediate clutch element in the direction of the first clutch element so the wedges of the first clutch element engage the grooves of the coupling ring.

It has proven to be a particularly preferred solution for the locking element to be spring-loaded in the direction of one of its two positions so displacement of the locking element into one of its two positions is possible merely by the latter being acted upon in a direction opposite to the force of the spring.

It has proven particularly expedient for the locking element to be spring-loaded in the direction of its effective position so it can be displaced by an actuating element in the direction of its ineffective position. The spring-loading in the direction of the effective position has the further advantage that engagement of the positive connection between the first clutch element and the locking element is facilitated by the locking element first being able to deviate in the direction of its ineffective position if the positive connection does not fit, yet engagement thereof occurs immediately if the positive connection fits and the locking element moves into its effective position.

For defined positioning of the tool drive shaft when the main tool is placed on the screw, it is advantageous for the axial displacement of the tool drive shaft to be delimitable in the direction of the drive by a rear stop position. The rear stop position is preferably formed by an axial bearing between the tool drive shaft and the housing, and, in particular, the axial bearing is arranged at an end of the tool drive shaft opposite the screwing tool.

In an embodiment of the inventive solution in which the connection between the intermediate clutch element and the second clutch element is implemented by cams, provision is expediently made for an engagement depth of the cams of the release clutch to be adjustable by the adjustment device.

The engagement depth of the cams can be varied by displacement of various parts. It is, for example, conceivable to vary the distance between the intermediate clutch element and the second clutch element. However, it is structurally considerably easier to implement a concept in which the distance between the first clutch element and the second clutch element is alterable by the adjustment device when the tool drive shaft is in the rear stop position.

This can likewise be implemented in various ways, It is, for example, possible to make the rear stop position of the tool drive shaft adjustable. However, it is easier for the second clutch element to be adjustable in the axial direction by the adjustment device.

The solution which is most expedient from a structural point of view makes provision for the clutch element driven by the drive to be displaceable in the axial direction by a displacement device acting as adjustment device.

The last-mentioned solution then offers further advantages for its structural implementation if the clutch element driven by the drive is supported on the displacement device at its side opposite the clutch element connected with the tool drive shaft.

The displacement device itself may be designed in many different ways. The displacement could, for example, be carried out via a spindle element. It is, however, easiest for the displacement device to comprise two adjusting rings rotatable relative to each other.

Simple axial displacement is then achievable with these adjusting rings by one adjusting ring comprising a displacement surface extending at an incline to the axis of rotation of the relative rotation for the other adjusting ring to rest with a supporting surface thereon. In particular, the supporting surface itself may also be designed as a displacement surface.

The relative rotation is easiest to achieve by one of the adjusting rings being mounted in a rotationally fixed manner and the other adjusting ring in a rotatable manner on the housing.

A turning device is expediently provided for turning the rotatably mounted adjusting ring.

An actuating element actuatable from outside the housing is provided for actuation of the turning device.

As mentioned in connection with a previous embodiment, the actuating element for the adjustment device should be accessible from outside the gear housing. For this reason, this actuating element must lead from the adjustment device out of the gear housing. Problems arise when the actuating element leads out of a gear housing section of the housing as the gear housing is filled with lubricant and hence hermetic sealing is necessary to prevent, on the one hand, escape of lubricant from the gear housing section and, on the other hand, entry of dirt into the gear housing section. For this reason, it is expedient for the actuating element to lead out of the housing outside of a gear housing section. Within the scope of the inventive screwing tool machine, the actuating element is preferably made to lead out of a motor housing section of the housing.

In the simplest case, provision is made for the actuating element to act on the rotatable adjusting ring via an intermediate member. It is, however, more advantageous for the intermediate member to be guided through a wall between the gear housing section and the motor housing section.

To find a structural solution in which paths from the actuating element to the adjustment device are as short as possible, it is advantageous for the adjustment device to be mounted on the wall between the gear housing section and the motor housing section.

In particular, where the intermediate member leads through the wall between the gear housing section and the motor housing section, a solution is expedient in which the adjusting ring which supports the clutch element driven by the drive is arranged in a rotationally fixed manner and the adjusting ring which is arranged on the opposite side of the clutch element in a rotatable manner.

This should, however, not exclude a solution in which the adjusting ring which supports the clutch element driven by the drive is arranged in a rotatable manner and the other adjusting ring in a rotationally fixed manner.

It is expedient for the adjustment device to be of such dimensions that it permits alteration of the distance between the clutch elements by at least half of the height of the cams. It is, however, more advantageous for the adjustment device to permit alteration of the distance between the clutch elements of the order of magnitude of the height of the cams.

Figure 2A:
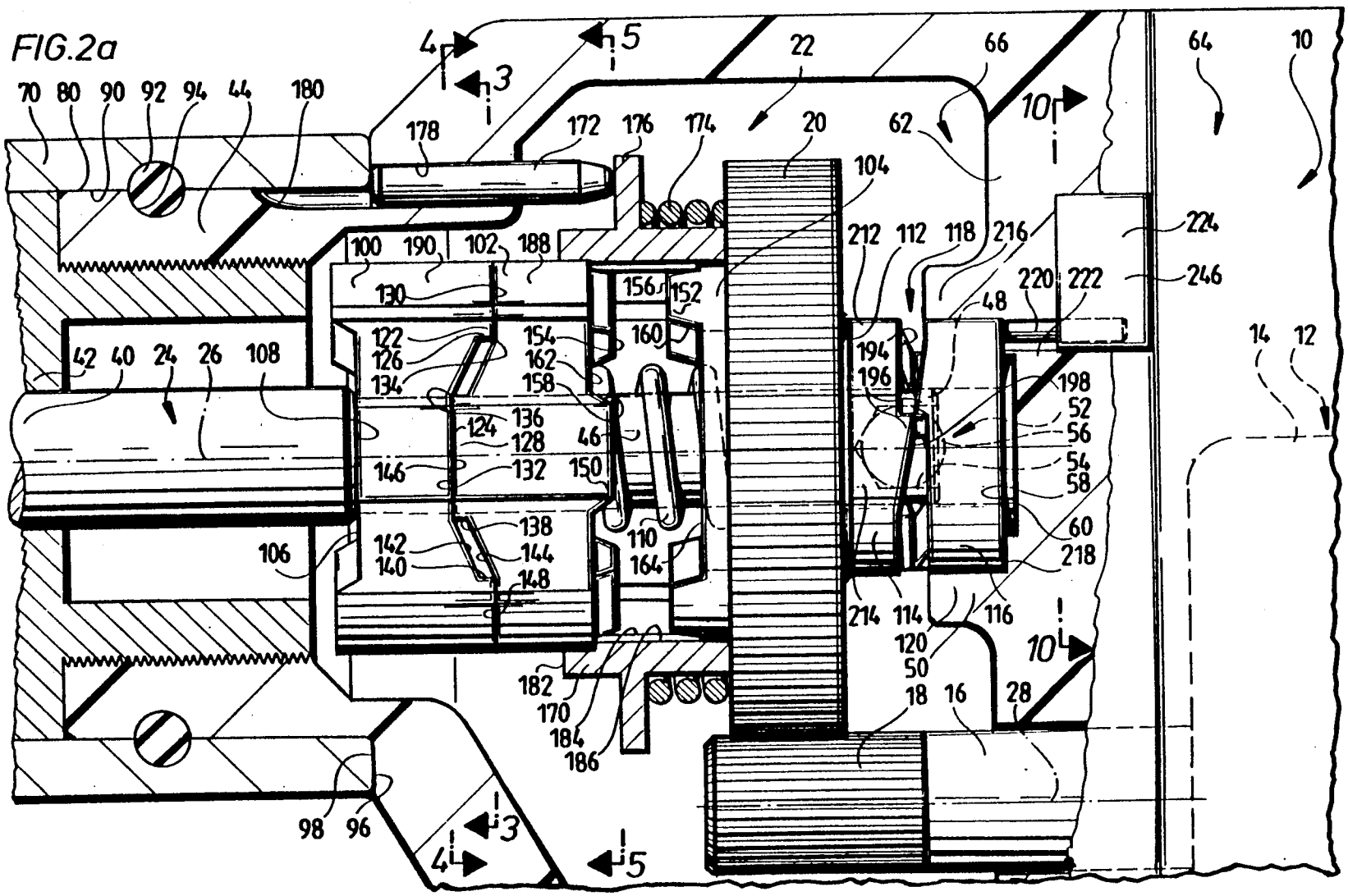
Figure 2B:
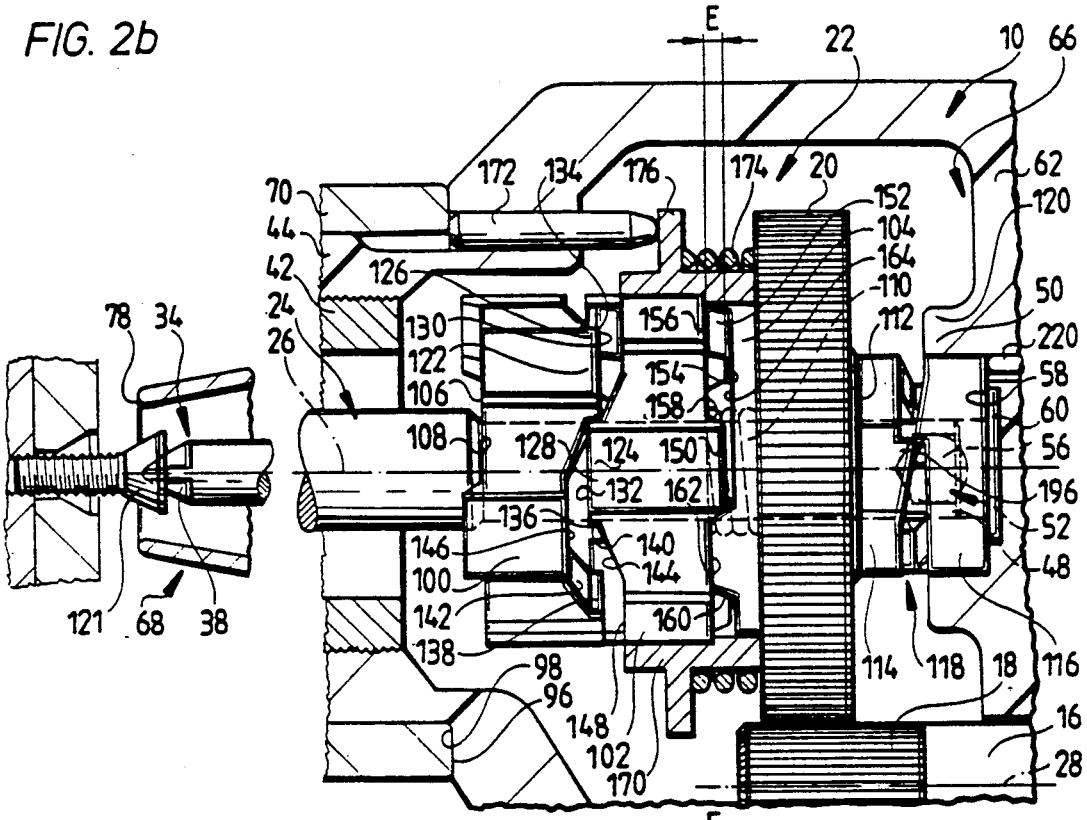
Figure 2C:
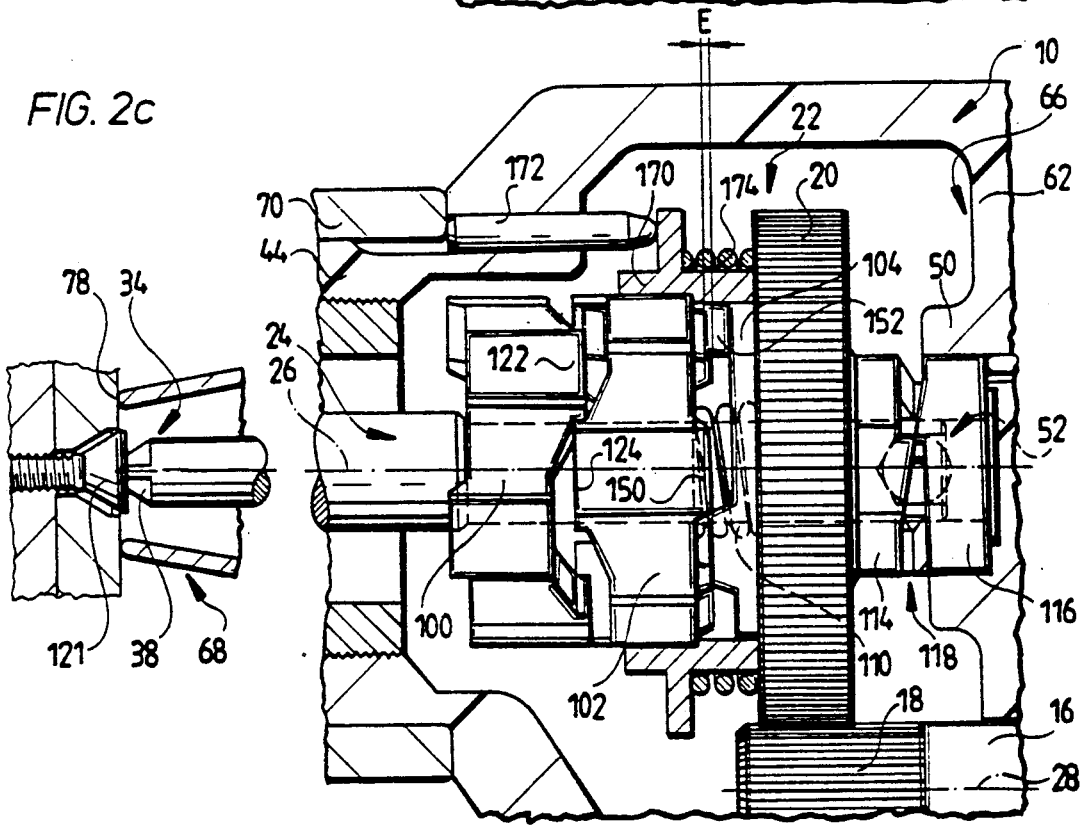
Figure 3:
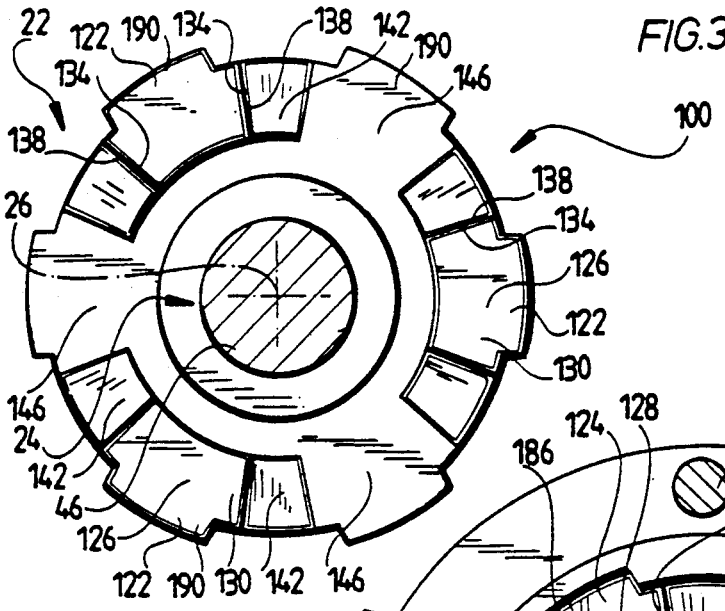
Figure 4:
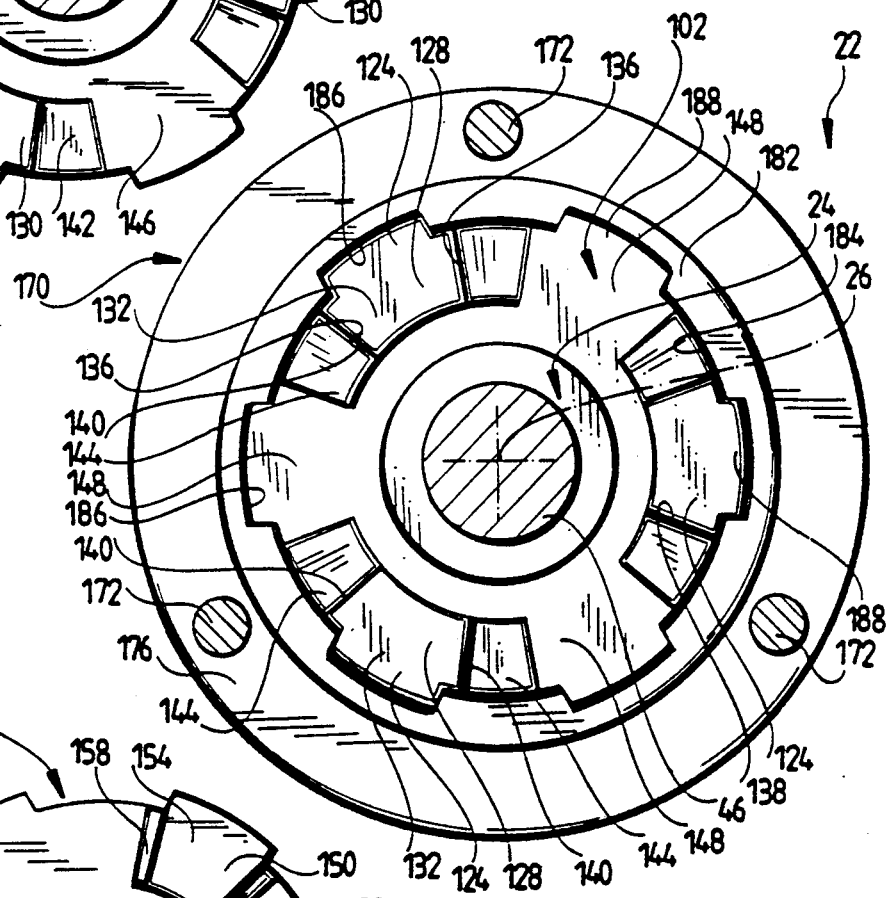
Figure 5:
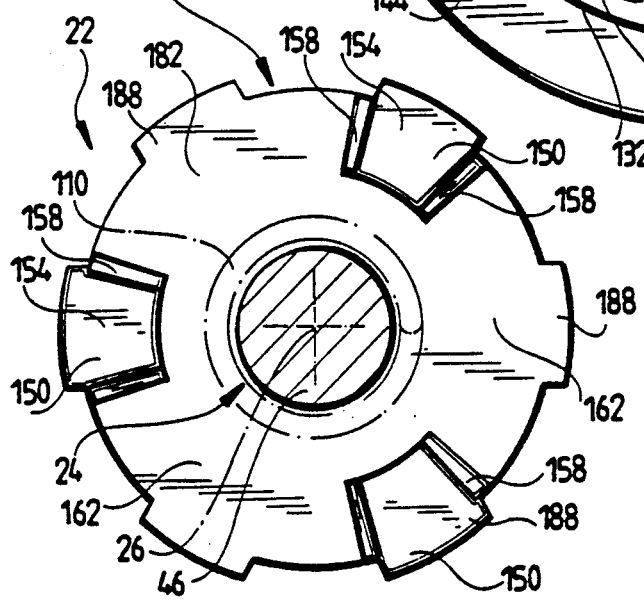
Figure 7:
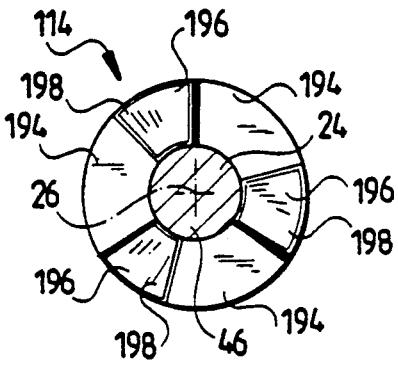
Figure 8:
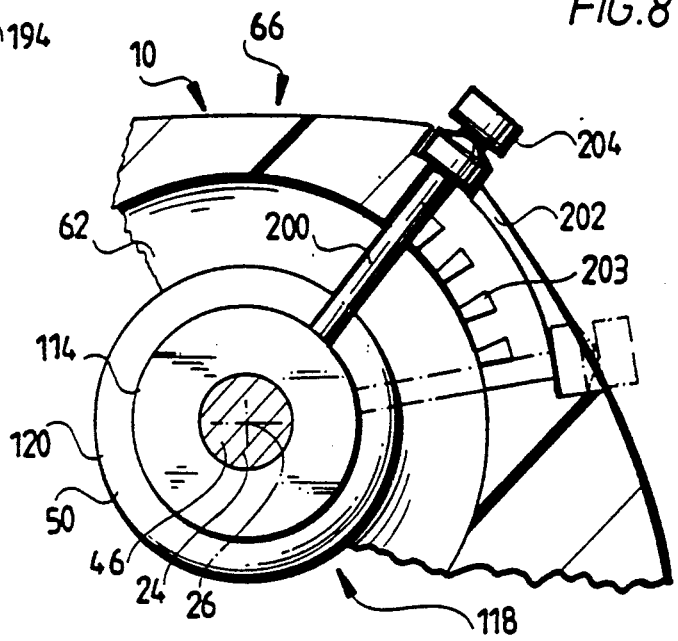
Figure 9:
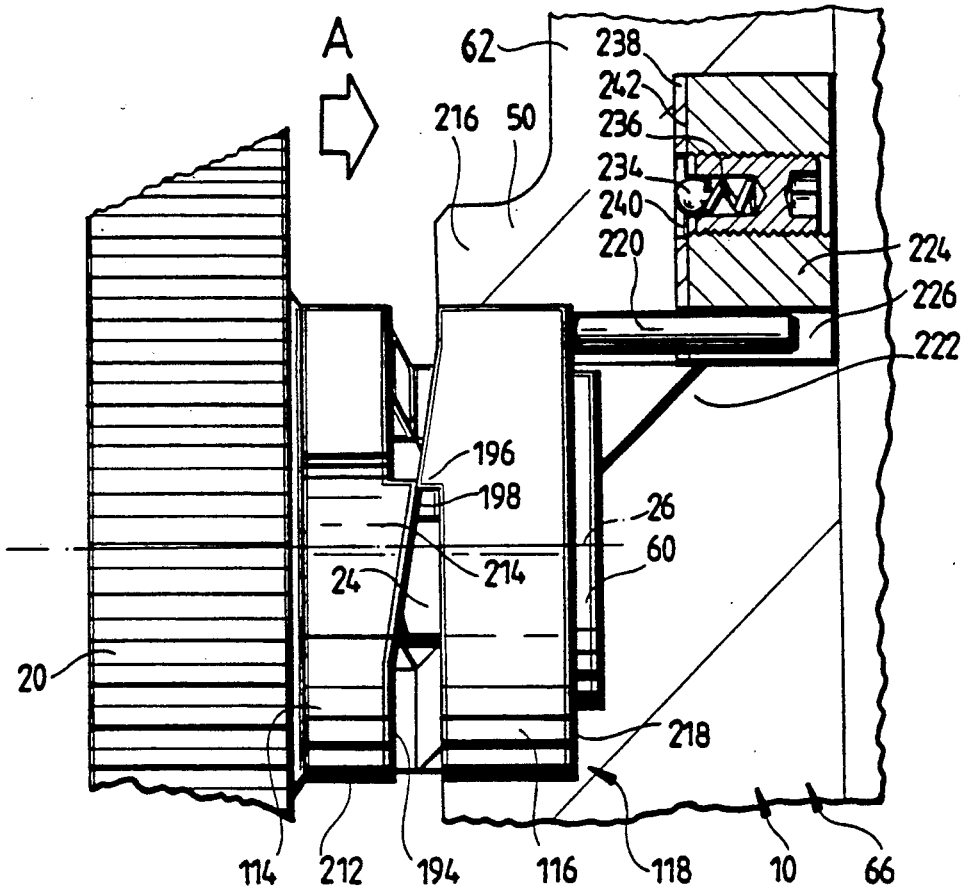
Figure 10:
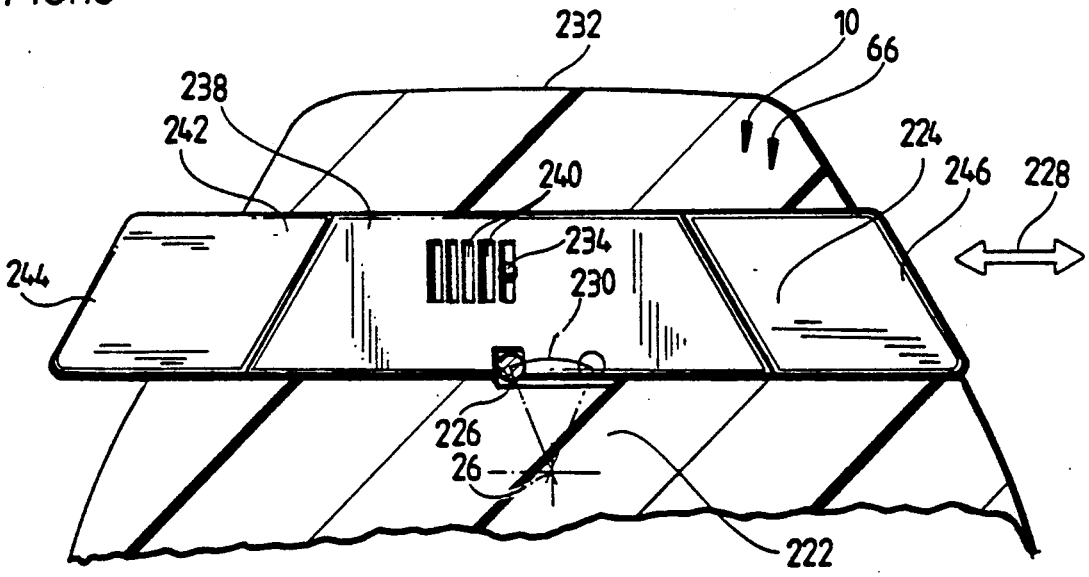

Further features and advantages of the invention are to be found in the following description and the appended drawings of an embodiment with variants. The drawings show:

FIG. 1 a partly broken-open side view of an inventive screwing tool machine;

FIGS. *2a* to *2c* a partial section through an inventive clutch with the locking element in its ineffective position;

FIG. 3 a plan view of a first clutch element in the direction of arrows 3—3 in FIG. 2;

FIG. 4 a plan view of an intermediate clutch element in the direction of arrows 4—4 in FIG. 2;

FIG. 5 a plan view of the intermediate clutch element in the direction of arrows 5—5 in FIG. 2;

FIGS. *6a* to *6c* a partly sectional illustration of the inventive clutch with the locking element in its effective position;

FIG. 7 a plan view of an adjusting ring of an inventive adjustment device;

FIG. 8 a first variant of a possibility of actuating an adjusting ring;

FIG. 9 a second variant of rotation of an adjusting ring;

FIG. 10 a section along line 10—10 in FIG. 2; and

Figure 11:
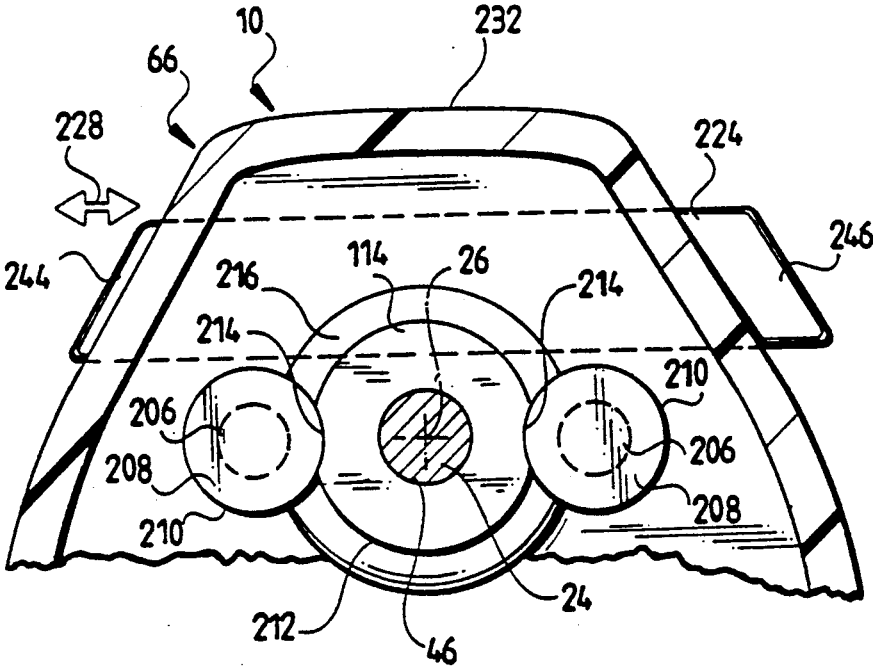

FIG. 11 a plan view in the direction of arrow A in FIG. 9.

An embodiment of an inventive screwing tool machine, illustrated in FIG. 1, comprises a housing designated in its entirety 10. A drive 12 comprising an electric motor with a rotor 14 seated on a motor shaft 16 is mounted in the housing 10. A front end of the motor shaft 16 is provided with a drive pinion 18.

This drive pinion 18 drives a gear wheel 20 which is connected to a clutch, designated in its entirety 22, via which a tool drive shaft 24 aligned such that its axis 26 extends parallel to a motor axis 28 of the motor shaft 16 is driven. A front section 30 of the tool drive shaft 24 opposite the drive 12 comprises a receiving means 32 for insertion of a screwing tool 34 with a matching piece 36 arranged at the rear end of the screwing tool 34. At a front end opposite the matching piece 36, the screwing tool is provided, for example, with a Phillips screwdriver 38.

The tool drive shaft 24 is mounted for rotation with a middle section 40 adjoining the front section 30 in a bearing sleeve 42 of the housing 10 and for displacement in the direction of its axis 26. The bearing sleeve 42 is screwed with an internal thread into a cylindrical front part 44 of the housing 10.

Adjoining the middle section 40 in the direction towards the drive 12 is a rear section 46 of the tool drive shaft 24 which is of smaller diameter than the middle section 40. This rear section 46 carries the clutch 22 and is received at its rear end 48 in a radial bearing 50. The rear section 46 is additionally provided with an axial bearing 52 comprising a ball 56 which is held in a rear recess 54 of the tool drive shaft 24, but does not constantly support the tool drive shaft 24 on a support surface 58 formed by a small metal plate 60, but rather only when the tool drive shaft is in its rear stop position, as illustrated, for example, in FIGS. *6b* and *6c*.

The axial bearing 52 and the radial bearing 50 are carried by a wall 62 which divides the housing 10 into a motor housing 64 and a gear housing section 66 located in front of this motor housing section. The motor shaft 16 protrudes with the drive pinion 18 into the gear housing section 66 which accommodates the clutch 22.

A depth stop, designated in its entirety 68, is positionable on the cylindrical front part 44 of the housing 10. The depth stop comprises an attachment sleeve 70 which embraces the cylindrical front part 44 with a snug fit. Adjoining the attachment sleeve 70 in the forward direction towards the screwing tool 34 is an adjustment sleeve carrier 72 in which an adjustment sleeve designated in its entirety 74 is arranged for rotation and adjustment by a thread 76 in the direction of the axis 26. A front supporting rim 78 of the depth stop 68 surrounding the screwdriver 38 serves as stop surface which determines a screw-in depth for the screw to be driven in.

The depth stop 68 itself is arranged together with its adjustment sleeve 74 coaxially with the axis 26. The cylindrical front part 44 is also arranged with its cylindrical circumferential surface 80 coaxially with the axis 26.

A rear part 82 of the adjustment sleeve 74 opposite the supporting rim 78 is additionally provided with external grooves 84 extending parallel to the axis 26. For lockable fixing of the rotary positions of the adjustment sleeve 74, a ball 88 acted upon elastically by an O ring 86 engages the external grooves 84.

The entire depth stop 68 is removable from the housing 10.

This is made possible by the attachment sleeve 70 being adapted to be pulled forward over the cylindrical front part in the direction of the axis 26. The attachment sleeve 70 is fixed in a locked manner on the cylindrical front part 44 by an O ring 92 which protrudes partly beyond an inside surface 90 of the attachment sleeve 70 and is mounted in an annular groove in the inside surface 90. The O ring 92 fits into an annular groove 94 machined in the cylindrical circumferential surface 80 and thereby fix the attachment sleeve 70 in the direction of the axis 26.

As shown, in particular, in FIG. 2, in this fixed position a rear end wall 96 rests against an annular surface 98 of the gear housing section 66 extending perpendicularly to the cylindrical circumferential surface 80 and delimiting the latter in the rearward direction.

The clutch 22 comprises a first clutch element 100, an intermediate clutch element 102 and a second clutch element 104, all three of which are seated on the rear section 46 of the tool drive shaft 24. The first clutch element 100 is rotationally fixedly and non-displaceably connected to the tool drive shaft 24 and lies with a front side 106 against an annular surface 108 of the transition between the rear section 46 and the middle section 40. On the side of the first clutch element 100 associated with the drive 12, the intermediate clutch element 102 is rotatably and axially displaceably mounted on the rear section 46. The second clutch element 104 is also mounted for rotation and axial displacement with respect to the rear section 46 on the latter and arranged on the side of the intermediate clutch element 102 associated with the drive 12.

In the embodiment of the inventive screwing tool machine shown in the drawings, the second clutch element 104 carries the gear wheel 20 which is driven by the drive pinion 18.

A spring 110 is arranged between the intermediate clutch element 102 and the second clutch element 104, thereby acting on the intermediate clutch element 102 in the direction of the first clutch element 100 and on the second clutch element 104 in the direction of the drive 12.

On its side remote from the intermediate clutch element 102, the second clutch element 104 lies with a rear side 112 against a first adjusting ring 114 which presses against a second adjusting ring 116. Both adjusting rings 114 and 116 form a displacement device 118 which will be described in detail below. Simultaneously, the rear adjusting ring 116 forms the radial bearing 50 by being held by an annular collar 120 of the wall 62. In addition, the second adjusting ring 116 extends to such an extent in the direction of the axis 26 that the tool drive shaft 24 with its rear section 46 is constantly held in the radial direction in all possible axial displacement positions by the second adjusting ring 116.

The clutch 22 can act in the manner known from European patent application No. 85115843.6 as switch-off means for the screw-in depth which interrupts torque transmission when a screw has been driven in to a preselectable screw-in depth without chattering of the clutch 22.

To this end, the clutch 22 is divided into an entrainment clutch formed by the first clutch element 100 and the intermediate clutch element 102 and into a release clutch formed by the intermediate clutch element 102 and the second clutch element 104.

To form the entrainment clutch, both the first clutch element 100 and the intermediate clutch element 102 have claws 122 and 124, respectively, which engage with one another. As shown, in particular in FIGS. 2, 3 and 4, the claws are shaped so as to have an elevation 126 and 128, respectively, which has an end face 130 and 132, respectively, facing the intermediate clutch element 102 and the first clutch element 100, respectively, and extending perpendicular to the axis 26. The end faces 130 and 132 have side edges 134 and 136, respectively, extending in the radial direction in relation to the axis 26 as best seen in FIGS. 3 and 4. Side surfaces 138 and 140, respectively, extend from these side edges 134 and 136, respectively, in the direction of the respective element, i.e., of the first clutch element 100 and the intermediate clutch element 102, with these side surfaces 138 and 140 representing partial surfaces of planes of a family of planes extending through the axis 26.

Adjacent to the side surfaces 138 and 140, the claws 122 and 124, respectively, terminate in side flanks 142 and 144, which exhibit an angle of inclination with respect to the axis 26, i.e., extend both at an angle to the end faces 130 and 132, respectively, and at an angle to the side surfaces 138 and 140. They thereby pass into a bearing surface 146 and 148, respectively, which is aligned parallel to the respective end face 130 and 132, respectively. The angles of inclination between the side flanks 142 and 144 and the axis 26 are preferably identical.

Operation of the entrainment clutch does not require that the claws 122 and 124 be of identical design. However, claws 122 and 124 of identical shape are advantageous as far as manufacture is concerned.

Operation of the entrainment clutch does also not require the bearing surfaces 146 and 148 to exhibit the same circular arc length as the end faces 130 and 132. In the present embodiment, this does, however, offer the advantage explained in further detail below that the claws 122 and 124, when in full engagement with one another, are centered relative to one another by the side flanks 142 and 144 adjoining the bearing surfaces 146 and 148 and hence stand in a defined position.

In the following embodiment, the release clutch is formed between the intermediate clutch element 102 and the second clutch element 104 by cams 150 and 152, respectively, arranged on facing sides of the two elements 102 and 104. The cams 150 and 152 have a cam end face 154 and 156, respectively, which stands perpendicularly to the axis 26 and has cam flanks 158 and 160 which proceed from this cam end face and likewise exhibit an inclination to the axis 26, i.e., extend at an incline to the cam end faces 154, 156 (FIG. 5).

Between the cams 150 and 152, the intermediate clutch element 102 and the second clutch element 104 comprise annular surface segments 162 and 164 standing in a plane perpendicular to the axis 26.

Three cams 150 and 152, respectively, with spaces therebetween which are as large as possible, are preferably arranged on both the intermediate clutch element 102 and the second clutch element 104. In relation to the circular arc length of the cam end faces 154, 156, these spaces constitute a multiple thereof (FIGS. 2, 5).

Proceeding from a position of rest illustrated in FIG. 2*a*, the clutch 22 operates in the known manner such that positioning of the screwdriver 38 on the screw 121 causes the tool drive shaft and hence also the clutch to be transferred from the position of rest to the work position. In the position of rest, owing to the action of the spring 110, the claws 122 and 124 of the first clutch element 100 and the intermediate clutch element 102 are centered relative to one another, i.e., the end faces 130 and 132, respectively, rest with their entire surface on the respective opposite bearing surfaces 146 and 148, respectively. On the other hand, the intermediate clutch element 102 and the second clutch element 104 are spaced by the action of the spring 110 at a distance from one another which is greater than the sum of the heights with which the cam end faces 154 and 156, respectively, rise above the annular surface segments 162 and 164, respectively, and so the cams 150 and 152 cannot engage with one another.

In the work position, the intermediate clutch element 102 is displaced in the direction of the second clutch element 104 to the extent that the cams 150 and 152 engage fully with one another, i.e., rest with their cam flanks 158 and 160 against one another. When the drive 12 is now switched on, a torque is transmitted from the second clutch element 104 to the intermediate clutch element 102, as a result of which the cams 150 and 152 remain in engagement owing to the greater incline of the cam flanks 158 and 160, respectively, while the claws 122 and 124 slide towards one another owing to the smaller incline of their side flanks 142 and 144, respectively, until their side surfaces 138 and 140, respectively, come to rest against one another. The sliding of the claws 122 and 124, respectively, on their side flanks 142 and 144, respectively, results, firstly, in relative rotation of the intermediate clutch element 102 with respect to the first clutch element 100 and, at the same time, proceeding from an intermediate clutch element 102 supported on the second clutch element 104, in a slight displacement of the first clutch element 100 together with the tool drive shaft 24 in the direction of the screw 121. Since the depth stop 68 only becomes effective with its supporting rim 78 when the screw 121 has been driven in to the required stop depth, until the screw 121 has reached this screw-in depth the tool drive shaft 24 remains acted upon in the direction of the drive 12 by the force with which the inventive screwing tool machine is placed on the screw 121 and the spring 110 is, therefore, compressed, whereby the cams 150 and 152 are kept in engagement with one another. The state shown in FIG. 2*b* is maintained until the screw 121 has reached the preselected screw-in depth.

Shortly before the screw-in depth is reached, the supporting rim 78 of the depth stop 68 already rests on a surface of the object into which the screw 121 is to be driven. Hence the tool drive shaft 24 will travel forwards in the direction of the screw as the screw-in depth increases and the spring 110 will ensure that the cams 150 and 152 remain in engagement with increasingly less cam coverage as the screw-in depth increases. The screw-in depth is reached when the cams 150 and 152 are able to slide over one another with their cam end faces 154 and 156, respectively. In this instant, however, the torque transmitted to the intermediate clutch element 102 ceases and so owing to the action of the spring 110, the intermediate clutch element 102 reverses the rotation carried out initially in the work position relative to the first clutch element 100 by the claws 122 and 124, respectively, sliding back on side flanks 142 and 144, respectively, into the position which they have in their initial position. The cam 150 is thereby removed by an additional amount from the cam 152, thereby preventing chattering of the clutch 22 which would otherwise occur as a result of the cams 150 and 152 striking one another. With interruption of the torque transmission to the intermediate clutch element 102, the torque transmission to the screw 121 also ceases and so the desired interruption of the screwing operation occurs at the screw-in depth.

Since not only switching-off of the screw-in depth but also switchover to switching-off of the torque is to be possible, with disengagement of the cams 150 and 152 with chattering of the latter being desired, the clutch 22 is provided with a coupling ring 170 which is held in an ineffective position by pins 172 (FIG. 2) so the clutch 22, as described above, can function. The pins 172 are acted upon by the bottom end wall 96 of the attachment sleeve 70 in the mounted state and hold the coupling ring 170 in a position in which it embraces the intermediate clutch element 102 and is also held by the latter coaxially with the axis 26, but protrudes from the intermediate clutch element 102 in the direction of the second clutch element 104, with the cams 150 and 152 being arranged so as to lie within the coupling ring 170. The coupling ring is, furthermore, acted upon in its ineffective position by a spring 174 in the direction of its effective position. The spring 174 embraces the coupling ring 170 and is supported, on the one hand, on the second clutch element 104 and acts, on the other hand, upon an annular flange 176 extending radially outwardly from the coupling ring 170. The coupling ring 170 is likewise held by the pins 172 in the ineffective position by the pins 172 acting upon the annular flange 176 against the force of the spring 174.

If the depth stop 68 is now removed, the rear end wall 96 of the attachment sleeve 70 ceases to act upon the pins 172 mounted in a bore 178 of the gear housing section 66. The pins 172 can, therefore, move forward until they rest against a delimiting surface 180 machined in the cylindrical front part 44. The coupling ring 170 is then also moved into its effective position shown in FIG. 6 by the force of the spring 174.

In this effective position, the coupling ring 170 is still guided and held concentrically with the axis 26 by the intermediate clutch element 102. However, the coupling ring 170 is displaced forwards in the direction of the first clutch element 100 to the extent that in the position of rest of the clutch 22, i.e., when the tool drive shaft 24 is moved forwards to the full extent, a front end face 182 of the coupling ring 170 terminates with the bearing surface 148 of the intermediate clutch element 102, i.e., does not protrude beyond this in the direction of the first clutch element 100. The coupling ring 170 remains in this position, held by the pins 172 and acted upon against these by the spring 174, as shown in FIGS. 6*a* to 6*c*.

Figure 6A:
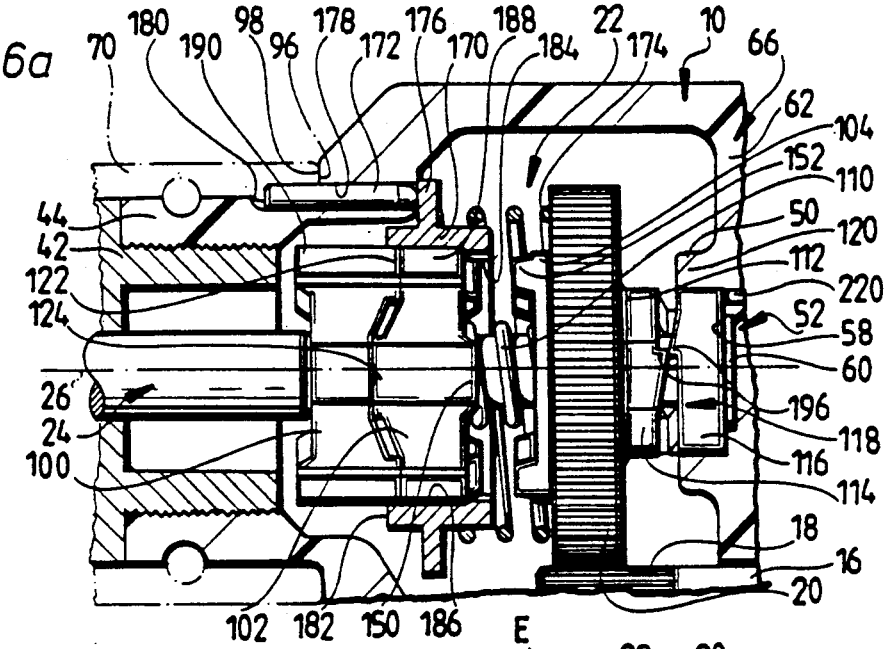
Figure 6B:
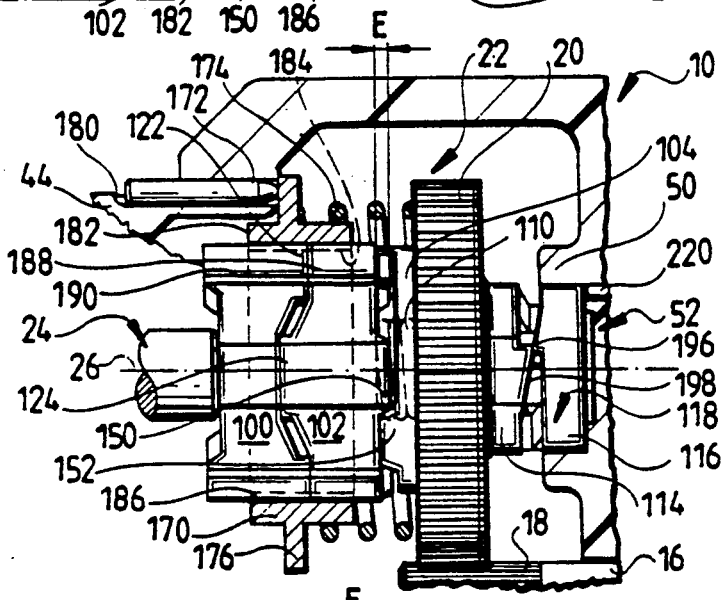
Figure 6C:
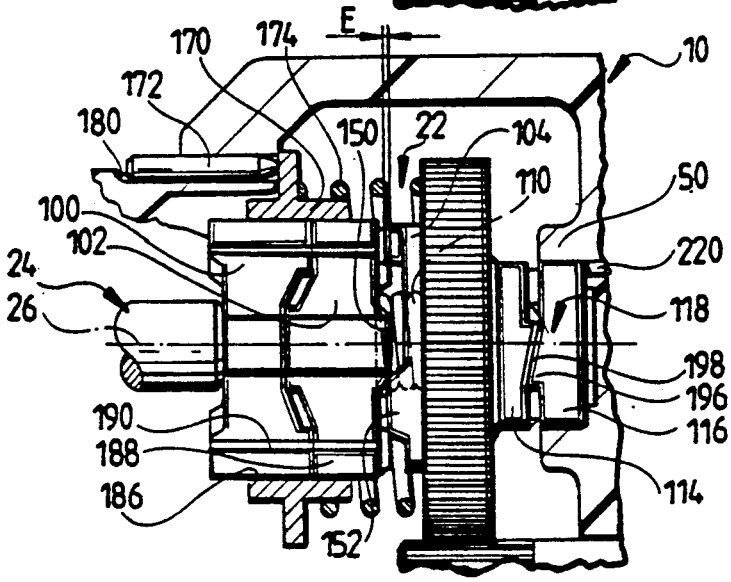

In order to act as locking element for the entrainment clutch between the first clutch element 100 and the intermediate clutch element 102, and to prevent rotation of the intermediate clutch element 102 relative to the first clutch element 100 during the transition from the load-free position, illustrated in FIGS. 2*a* and 6*a*, to the load position, illustrated in FIGS. 2*b* and 2*c*, the coupling ring 170 has grooves 186 extending on an inside circumferential surface 184 (FIG. 4) in the direction of the axis 26. Wedges 188 protruding radially outwardly from the intermediate clutch element 100 engage these grooves 186 in a positively connected manner so the coupling ring 170 is held in a rotationally fixed manner on the intermediate clutch element 102.

Owing to the alignment of the grooves 186 and wedges 188 in the axial direction, the coupling ring 170 is also displaceable parallel to the axis 26.

In the same way as the intermediate clutch element 102, the first clutch element 100 comprises radially outwardly extending wedges 190 having the same shape as the wedges 188 so the coupling ring 170, proceeding from the intermediate clutch element 102, can also be made to engage the wedges 190 in a rotationally fixed manner.

In accordance with the invention, the wedges 188 are arranged relative to the claws 124 and the wedges 190 relative to the claws 122 such that the wedges 190 can be made to engage the grooves 186 in the coupling ring 170, in the grooves of which the wedges 188 already engage, when the claws 124 and 122 are in their load-free position shown in FIGS. 2*a* and 6*a*, i.e., in a position in which the claws 122, 124 are held centered by the respective side flanks 142, 144 of the respective other claw.

Proceeding from the position of rest of the clutch 22, in which the claws 122, 124 are in their load-free position, and the effective position of the coupling ring 170, shown in FIG. 6*a*, placing of the screwing tool 34 on the screw 121 results in the tool drive shaft 24 being displaced rearwardly in the direction of the drive 12 and, therefore, in the clutch 22 also being displaced from its position of rest to its work position.

Since the first clutch element 100 and the intermediate clutch element 102, proceeding from the position of rest, are standing in the load-free position of the claws 122 and 124 and no torque is being applied to these from the driving torque, displacement of the first clutch element 100 and the intermediate clutch element 102 in the direction of the drive 12 results in the wedges 190 of the first clutch element 100 sliding into the grooves 186 of the coupling ring 170 and hence in locking of rotation of the intermediate clutch element 102 relative to the first clutch element 100 before the cams 150 of the intermediate clutch element 100 can engage with the cams 152 of the second clutch element 104 and hence enable torque transmission. The entrainment clutch between the first clutch element 100 and the intermediate clutch element 102 is, therefore, locked so these two act as a single clutch element which together with the second clutch element 104 forms the switch-off means for the torque which is operative when a maximum torque is exceeded, this maximum torque being dependent on the incline of the cam flanks 158, 160, on the force exerted by the screw 121 on the tool drive shaft 24 in the direction of the drive 12 and on an engagement height E of the cams 150 and 152.

This engagement height E is adjusted via the above-mentioned adjustment device 118 which comprises the first adjusting ring 114 and the second adjusting ring 116. As shown by way of example on the adjusting ring 114 in FIG. 7, each of the two adjusting rings 114 and 116 comprises on end faces 194 which face each other adjusting wedges 196 which rise from these end faces 194 and have a displacement surface 198 rising at an incline to the end face 194. The displacement surface 198 is at an inclination with respect to an axis of rotation of the displacement surface 198 and hence, in the illustrated embodiment, with respect to the axis 26.

The two adjusting rings 114, 116 can stand in an initial position such that the respective adjusting wedge 196 of the one adjusting ring 114 rests on the respective end face 194 of the other adjusting ring 116 and vice-versa. By relative rotation of the adjusting rings 114, 116, the adjusting wedges 196 can come to rest on one another so the displacement surfaces 198 slide on one another and consequently press the two adjusting rings 114, 116 apart. This is possible until maximum displacement of the adjusting rings 114, 116 relative to each other is reached, in which case the adjusting wedges 196 stand on one another with the respective highest elevations of the displacement surfaces 198 over the respective end face 194.

The position in which the adjusting rings 114, 116 have reached the maximum displacement is shown in FIG. 6*b*. The maximum displacement is selected such that the engagement height of the cams 150, 152 is maximum, i.e., corresponds substantially to the height of the cams.

The initial position of the rings 114, 116 is shown in FIG. 6*c*, with the difference in the path of displacement between the maximum displacement and the initial position corresponding to the difference between the maximum engagement height E of cams 150, 152 and the minimum engagement height E of cams 150, 152. In the case of the minimum engagement height E, illustrated in FIG. 6*c*, the cams engage one another only with their regions of the cam flanks 158, 160 immediately adjoining the respective cam end faces 154, 156.

In the simplest case, rotation of the adjusting rings 114, 116 relative to each other can be implemented by the second adjusting ring 116 being firmly anchored on the wall 62 and the first adjusting ring 114 comprising a lever 200 extending radially outwardly in relation to the axis 26, as shown in FIG. 8. The lever 200 extends through an opening 202 of the gear housing section 66 and has a gripping part 204 located outside the latter. The opening 202 is of such dimensions that a swivel angle of the lever 200 causes relative rotation of the adjusting rings 114, 116 from the initial position to the position of maximum displacement. The opening 202 preferably also has detent knobs 203 for detention of the lever 200 in various positions.

A preferred alternative to this highly simple embodiment of a possibility for rotation of the adjusting rings 114, 116 relative to each other according to the invention is illustrated in FIGS. 9, 10 and 11. In this embodiment, in contrast with the above-mentioned embodiment, the first adjusting ring 114 is rotationally fixedly held with respect to the wall 62. This is preferably implemented by two holding pins 206 with circular-cylindrical heads 208 which are arranged with respect to the axis 26 on opposite sides of the first adjusting ring 114 such that the heads 208 engage with their outer circumference 210 in recesses 214 formed in accordance with the outer circumference in an outer circumference 212 of the first adjusting ring 114 and thereby prevent rotation of the first adjusting ring 114.

The second adjusting ring 116 is surrounded by a toroidal member 216 formed on the wall 62 and mounted by this toroidal member for rotation in the wall 62. A rotary pin 220 projects from this second adjusting ring 116 on the enu face 218 thereof opposite the first adjusting ring 114. This rotary pin 220 extends through the wall 62 in a region 222 located within the toroidal member 216 and protrudes beyond the wall 62 into the motor housing section 64.

The rotary pin 220 is preferably aligned parallel to the axis 26.

A slide 224 is arranged in the motor housing section 64, thereby extending through the latter transversely to the axis 26. The slide 224 has a recess machined therein in the form of a receiving means 226 for the rotary pin 220. The rotary pin 220 is arranged such that the slide 224 with the receiving means 226 is displaceable approximately tangentially to the arc segment 230 on which the rotary pin 220 extends during relative rotation of the adjusting rings 114, 116 from the initial position to the position of maximum displacement. The direction of displacement 228 of the slide 224 preferably lies parallel to a top housing surface 232.

To enable the slide 224 to be fixed in different positions, in particular also in intermediate positions between the initial position and the position of maximum displacement, a detent element in the form of a spring-loaded detent ball 234 is provided in the slide 224. The detent ball 234 is pressed by a spring 236 against a detent plate 238 which has detent slots 240 extending parallel to one another and transversely to the direction of displacement 228 and is firmly anchored on the wall 62 on the side thereof facing the slide 224. The slide 224 rests with a front side 242 against the detent plate 238 and the detent ball 234 protrudes beyond the front side 242.

The slide 224 preferably comprises two gripping parts 244 and 246 protruding on opposite sides beyond the housing, and the slide is preferably of such dimensions that in the initial position of the adjusting rings 114, 116, the one gripping part 244 and in the position of maximum displacement, the other gripping part 246 protrudes at the side beyond adjacent regions of the housing 10.

A particularly expedient embodiment is advantageously designed such that the slide 224 does not protrude in any position beyond an entire contour of the housing.

Hence the displacement device 118 is adjustable by the slide 224, which enables the release characteristic of the release clutch between the intermediate clutch element 102 and the second clutch element 104 to be adjusted with the coupling ring 170 in its effective position. In addition to a switch-off means for the screwing depth including a depth stop and operating without chattering, the inventive screwing tool machine, therefore, comprises a switch-off means for the torque with an adjustable release characteristic.

The present disclosure relates to the subject matter disclosed in German application No. P 39 18 227.4 of June 3, 1989, the entire specification of which is incorporated herein by reference.

What is claimed is:

1. A power-operated screwdriver comprising:

a drive arranged in a housing;

a screwing tool connected to a tool drive shaft axially displaceable relative to said housing;

a screw-in depth switch-off means including a depth stop held on said housing for fixing a screw-in depth and a clutch arranged between said drive and said tool drive shaft and transferable by axial displacement of said tool drive shaft in the direction of said drive from a position of rest into a working position, said clutch including a clutch element driven by said drive, a clutch element connected to said tool drive shaft and an intermediate clutch element arranged between these clutch elements, said intermediate clutch element forming with a first one of said clutch elements an entrainment clutch which in the case of load axially displaces said intermediate clutch element from a load-free position outwards said other, second clutch element into a load position maintaining torque transmission, and said intermediate clutch element forming with said second clutch element a release clutch which interrupts torque transmission when said screw-in depth is reached;

said screwdriver further including:

switching means for switching between said screw-in depth switch-off means and a screw-in torque switch-off means integrating said release clutch as a torque-limiting element, and means for adjusting said switching means between a first position wherein said release clutch interrupts torque transmission upon reaching a predetermined screw-in depth and a second position wherein said release clutch interrupts torque transmission upon reaching a predetermined torque.

2. A screwdriver as defined in claim 1, wherein said entrainment clutch is lockable against load-dependent, axial displacement of said intermediate clutch element in the direction of said first clutch element when said release clutch disengages.

3. A screwdriver as defined in claim 2, wherein said entrainment clutch is lockable in said load-free position or said load position against load-dependent, axial displacement of said intermediate clutch element when said release clutch disengages.

4. A screwdriver as defined in claim 2, further comprising a locking element adjustable between an effective position for locking said entrainment clutch and an ineffective position.

5. A screwdriver as defined in claim 4, wherein said locking element is actuatable from said outside housing.

6. A screwdriver as defined in claim 4, wherein said locking element is inactive in said effective position when said clutch is in said position of rest and is activatable by a transfer of said clutch from said position of rest to said working position.

7. A screwdriver as defined in claim 4, wherein said locking element is spring-loaded in the direction of one of its two positions.

8. A screwdriver as defined in claim 7, wherein said locking element is spring-loaded in the direction of its effective position.

9. A screwdriver as defined in claim 1, wherein said depth stop can be brought into an ineffective position.

10. A screwdriver as defined in claim 9, wherein said depth stop is in said ineffective position when said entrainment clutch is locked.

11. A screwdriver as defined in claim 10, wherein said locking element is actuatable by said depth stop.

12. A screwdriver as defined in claim 11, wherein:

said depth stop can be slipped onto said housing, said locking element is in its ineffective position when said depth stop is in position, and said locking element is in its effective position when said depth stop is removed.

13. A screwdriver as defined in claim 1, wherein said adjustment device is provided for adjustment of a release characteristic of said screw-in torque switch-off means.

14. A screwdriver as defined in claim 13, wherein said adjustment device is adjustable by an actuating element accessible from outside said housing.

15. A screwdriver as defined in claim 13, wherein the release torque of said release clutch is adjustable with said adjustment device.

16. A screwdriver as defined in claim 14, wherein said actuating element is guided out of said housing outside of a gear housing section.

17. A screwdriver as defined in claim 16, wherein said actuating element is guided out of a motor housing section of said housing.

18. A screwdriver as defined in claim 16, wherein an intermediate member is guided through a wall between said gear housing section and said motor housing section.

19. A screwdriver as defined in claim 18, wherein said adjustment device is mounted on said wall between said gear housing section and said motor housing section.

20. A screwdriver as defined in claim 1, wherein said entrainment clutch comprises at least one actuating surface arranged at an incline with respect to an axis of said clutch elements, and said actuating surface acts upon a counter-surface upon rotation of said first clutch element and said intermediate clutch element relative to each other, said actuating surface displacing said intermediate clutch element in the axial direction from said load-free position to said load position.

21. A screwdriver as defined in claim 20, wherein said actuating surface is designed as a side flank of a claw.

22. A screwdriver as defined in claim 20, wherein in said load-free position, said entrainment clutch positions said first clutch element and said intermediate clutch element in a defined manner with respect to a relative rotation thereof.

23. A screwdriver as defined in claim 22, wherein said flanks of successive claws of one of said intermediate clutch element and said first clutch element center said claw of the other of said first clutch element and said intermediate clutch element which side flanks engage between said clutch elements in said defined load-free position.

24. A screwdriver as defined in claim 20, wherein a locking element locks rotation of said intermediate clutch element relative to said first clutch element.

25. A screwdriver as defined in claim 24, wherein said locking element is a coupling ring for said intermediate clutch element and said first clutch element.

26. A screwdriver as defined in claim 25, wherein said coupling ring in its effective activated position locks said intermediate clutch element and said first clutch element in a rotationally fixed manner by a positive connection.

27. A screwdriver as defined in claim 25, wherein said coupling ring is guided in its effective and ineffective positions by said intermediate clutch element coaxially therewith.

28. A screwdriver as defined in claim 1, wherein said intermediate clutch element is spring-loaded in the direction of its load-free position.

29. A screwdriver as defined in claim 1, wherein said release clutch comprises a cam on said intermediate clutch element arranged to face a cam on said second clutch element.

30. A screwdriver as defined in claim 29, wherein an engagement depth of said cams of said release clutch is adjustable with said adjustment device.

31. A screwdriver as defined in claim 30, wherein a distance between said first clutch element and said second clutch element is alterable by said adjustment device when said tool drive shaft is standing in said rear stop position.

32. A screwdriver as defined in claim 30, wherein said second clutch element is adjustable in the axial direction with said adjustment device.

33. A screwdriver as defined in claim 30, wherein said clutch element driven by said drive is displaceable in the axial direction by a displacement device acting as the adjustment device.

34. A screwdriver as defined in claim 33, wherein said clutch element driven by said drive is supported on said displacement device on the side thereof opposite said clutch element connected to said tool drive shaft.

35. A screwdriver as defined in claim 33, wherein said displacement device comprises two adjusting rings rotatable relative to each other.

36. A screwdriver as defined in claim 35, wherein one adjusting ring comprises a displacement surface extending at an incline to the axis of rotation of the relative rotation for said other adjusting ring, to rest with a supporting surface thereon.

37. A screwdriver as defined in claim 35, wherein said adjusting ring supporting said clutch element driven by said drive is arranged in a rotationally fixed manner and said adjusting ring is arranged on the opposite side of this clutch element in a rotatable manner.

38. A screwdriver as defined in claim 29, wherein said adjustment device permits alteration of the distance between said clutch elements by at least half the height of said cams.

39. A screwdriver as defined in claim 38, wherein said adjustment device permits an alteration of said distance between said clutch elements on the order of magnitude of the height of said cams.

40. A screwdriver as defined in claim 1, wherein axial displacement of said tool drive shaft in the direction of said drive is delimitable by a rear stop position.

* * * * *

UNITED STATES PATENT AND TRADEMARK OFFICE

CERTIFICATE OF CORRECTION

PATENT NO. : 5,094,133

DATED : March 10, 1992

INVENTOR(S) : Schreiber

It is certified that error appears in the above-identified patent and that said Letters Patent is hereby corrected as shown below:

In claim 1, at column 16, line 9, "outwards" should read -- towards -- .

In column 15, line 1, "enu" should read -- end -- .

Signed and Sealed this

Twenty-fifth Day of May, 1993

*Attest:*

Michael K. Kirk

MICHAEL K. KIRK

*Attesting Officer*

*Acting Commissioner of Patents and Trademarks*